US007358488B2

(12) United States Patent
Chernushevich et al.

(10) Patent No.: US 7,358,488 B2
(45) Date of Patent: Apr. 15, 2008

(54) MASS SPECTROMETER MULTIPLE DEVICE INTERFACE FOR PARALLEL CONFIGURATION OF MULTIPLE DEVICES

(75) Inventors: Igor V. Chernushevich, North York (CA); Alexandre V. Loboda, Toronto (CA); Bruce A. Thomson, Toronto (CA); Andrew N. Krutchinsky, San Francisco, CA (US)

(73) Assignees: MDS Inc., Concord, Ontario (CA); University of Manitoba, Winnipeg, Maitoba (CA)

( * ) Notice: Subject to any disclaimer, the term of this patent is extended or adjusted under 35 U.S.C. 154(b) by 381 days.

(21) Appl. No.: 11/222,971

(22) Filed: Sep. 12, 2005

(65) Prior Publication Data

US 2007/0057178 A1 Mar. 15, 2007

(51) Int. Cl.
*H01J 49/06* (2006.01)

(52) U.S. Cl. ..... 250/288; 250/292; 250/285; 250/282; 250/281

(58) Field of Classification Search ..... None
See application file for complete search history.

(56) References Cited

U.S. PATENT DOCUMENTS

| | | | |
|---|---|---|---|
| 4,963,736 | A | 10/1990 | Douglas et al. |
| 6,410,914 | B1 | 6/2002 | Park |
| 7,109,476 | B2 | 9/2006 | Hanold |
| 2004/0188605 | A1 | 9/2004 | Tang |
| 2005/0279931 | A1 | 12/2005 | Franzen et al. |

FOREIGN PATENT DOCUMENTS

WO WO 02/086489 A1 10/2002

OTHER PUBLICATIONS

PCT International Search Report and Written Opinion dated Dec. 12, 2006 issued in foreign counterpart PCT Appln. No. PCT/CA2006/001494.

Badman et al., A Quadrupole Ion Trap Mass Spectrometer with Three Independent Ion Sources for the Study of Gas-Phase Ion/Ion Reactions, Anal. Chem., 2002, 74, 6237-6243.

Coon et al., Anion dependence in the partitioning between proton and electron transfer in ion/ion reactions, Int. J. Mass Spectrom. 2004, 236, pp. 33-42.

Krutchinsky, Andrew N. et al., Rapidly Switchable Matrix-Assisted Laser Desorption/Ionization and Electrospray Quadrupole-Time-of-Flight Mass Spectrometry for Protein Identification, J. Am Soc Mass Spectrom 2000, 11, 493-504.

Stephenson et al., Adaptation of the Paul Trap for study of the reaction of multiply charged cations with singly charged anions, Int. J. Mass Spectrom. Ion Processes, 162, pp. 89-106, 1997.

*Primary Examiner*—Jack I. Berman
*Assistant Examiner*—Zia R. Hashmi
(74) *Attorney, Agent, or Firm*—Nixon & Vanderhye

(57) ABSTRACT

A multi-device interface for use in mass spectrometry for interfacing one or more ion sources to one or more downstream devices. The multi-device interface comprises three or more multipole rod sets configured as either an input rod set or an output rod set depending on potentials applied to the multipole rod sets. The multipole rod sets configured as an input rod set are connectable to the one or more ion sources for receiving generated ions therefrom and sending the ions to at least one multipole rod set configured as an output multipole rod set. The output multipole rod sets are connectable to a downstream device for sending the generated ions thereto. At least two of the multipole rod sets are configured as input rod sets or at least two of the multipole rod sets are configured as output rod sets.

24 Claims, 10 Drawing Sheets

MASS SPECTROMETER MULTIPLE DEVICE INTERFACE FOR PARALLEL CONFIGURATION OF MULTIPLE DEVICES

FIELD OF THE INVENTION

The invention relates to a multiple device interface for mass spectrometer devices. More particularly, this invention relates to a multiple device interface for interfacing several devices together in a parallel configuration for mass spectrometry.

BACKGROUND OF THE INVENTION

Existing mass spectrometers usually analyze ions from one ion source at a time. Exceptions include the use of ion traps, or when a second ion source is used which is a built-in electron impact ionization source. One way to couple multiple ion sources to a 3D ion trap includes injecting ions from a second ion source through a hole in the ring electrode of the ion trap, as described in Stephenson, J. L and McLuckey, S. A. (1997), Int. J. Mass Spectrom. Ion Processes, 162, pp. 89-106. Another way includes using a turning quadrupole. This method is not limited to 3D ion traps and can be used for various analyzers. For example, in one case, three ion sources were coupled to an ion trap through the turning quadrupole, as described in Badman, E. R.; Chrisman, P. A. and McLuckey, S. A., 2002, Anal. Chem., 74, pp. 6237-6243. However, in the configuration taught by Badman et al., the three ion sources could not simultaneously supply ions to the ion trap. In limited cases, some two-dimensional ion traps (or linear traps) can be used to accept ions from two ion sources and allow the ions sources to operate simultaneously (Coon J. J., Syka, J. E. P., Schwartz, J. C., Shabanowitz, J., and Hunt, D. F., 2004, Int. J. Mass Spectrom., 236, pp. 33-42).

Another approach for a multi-input ion source is described in Krutchinsky, A. N.; Zhang, W. and Chait, B. T., 2000, "Rapidly Switchable MALDI and Electrospray Quadrupole-Time-of-Flight Mass Spectrometry for Protein Identification", J. Am. Soc. Mass Spectrometry, V. 11, pp. 493-504. Krutchinsky et al. describe a mass spectrometer with rapidly switchable MALDI and electrospray ion sources. However, this instrument requires one of the ion sources to be a MALDI source. Further, the MALDI source must be a specially designed MALDI source. Lastly, the multiple ion sources cannot be used simultaneously with this instrument since the two ion sources are arranged in series rather than in parallel.

Unfortunately, for most existing ion sources, manual interference is required when changing from one ion source to another ion source, such as when changing between an ESI ion source and an oMALDI ion source, for example. The manual interference usually involves venting at least part of the vacuum chamber, resulting in a noticeable pump-down time before the machine is back in operation.

SUMMARY OF THE INVENTION

In one aspect, at least one embodiment of the invention provides a multi-device interface for use in mass spectrometry for interfacing one or more ion sources to one or more downstream devices. The multi-device interface comprises three or more multipole rod sets configured as either an input rod set or an output rod set depending on potentials applied to the multipole rod sets. The multipole rod sets that are configured as an input rod set have an inlet portion and an outlet portion, the inlet portion being connectable to one of the one or more ion sources for receiving ions generated therefrom and transmitting the generated ions to the outlet portion. The multipole rod sets that are configured as an output multipole rod set have an inlet portion and an outlet portion, the inlet portion being adjacent to the outlet portion of at least one of the multipole rod sets that are configured as an input rod set to receive and transmit the generated ions to the outlet portion of the output multipole rod set. The outlet portion of the output multipole rod set is connectable to a downstream device. At least two of the multipole rod sets are configured as input rod sets or at least two of the multipole rod sets are configured as output rod sets.

In another aspect, at least one embodiment of the invention provides a multi-device interface for use in mass spectrometry for interfacing two or more ion sources to a downstream device. The multi-device interface comprises two or more input pathways having an inlet portion and an outlet portion, the inlet portion of each input pathway being connected to one of the multiple ion sources for receiving ions generated therefrom and transmitting the generated ions to the outlet portion; a combination area in which the generated ions are combined to form combined ions, the combination area being located adjacent to the outlet portions of each of the input rod sets; and, an output pathway having an inlet portion and an outlet portion, the inlet portion being adjacent to the combination area for receiving the combined ions and transmitting the combined ions to the outlet portion of the output pathway and the outlet portion of the output pathway being connected to the downstream device.

In a further aspect, at least one embodiment of the invention provides a multi-device interface for use in mass spectrometry for interfacing one or more ion sources to one or more downstream devices. The multi-device interface comprises three or more pathways and a transition area. The plurality of pathways are configured as either an input pathway, an output pathway or an unused pathway. Each of the plurality of pathways that is configured as an input pathway is connected to and provides a separate pathway to the transition area. Each of the plurality of pathways that is configured as an output pathway is connected to the transition area and is connectable to one of the downstream devices. During use, each of the plurality of pathways that is configured as an input pathway is connectable to a different ion source for receiving generated ions therefrom and leading the generated ions to the transition area where the generated ions are sent to one of the plurality of pathways that is configured as an output pathway and is connected to one of the downstream devices.

BRIEF DESCRIPTION OF THE DRAWINGS

For a better understanding of the invention and to show more clearly how it may be carried into effect, reference will now be made, by way of example only, to the accompanying drawings which show at least one exemplary embodiment of the invention and in which.

DETAILED DESCRIPTION OF THE INVENTION

Figure 1:
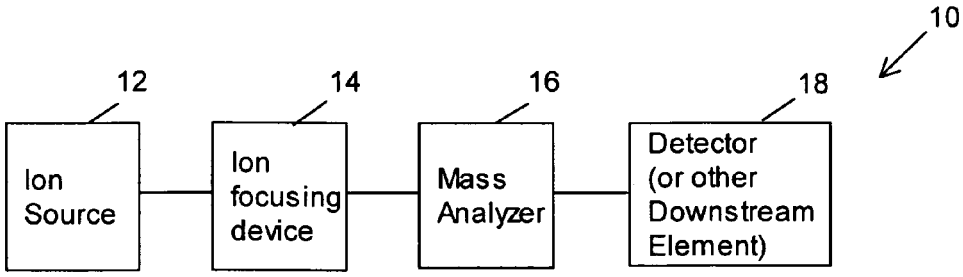
FIG. 1 is a block diagram of an exemplary embodiment of a conventional mass spectrometer system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements. In addition, numerous specific details are set forth in order to provide a thorough understanding of the invention. However, it will be understood by those of ordinary skill in the art that the invention may be practiced without these specific details. In other instances, well-known methods, procedures and components have not been described in detail so as not to obscure the invention. In some cases, dimensions and tolerances for various parts will be given; however, this is not done to limit the scope of the invention, but rather to provide details for working embodiments thereof.

In general, the invention provides a multi-device interface that allows for the configuration, and possibly simultaneous operation, of multiple devices for mass spectrometry analysis. In one aspect, various embodiments of the invention provide a multi-device interface that can receive input samples from several different ion sources and provide the multiple input samples to a downstream device such as a mass spectrometer, for example. The multi-device interface may be configured to allow the different ion sources to be operated simultaneously. The multi-device interface may also be operable without requiring manual intervention for switching between the different ion sources. Accordingly, the multi-device interface of the invention reduces total analysis time because the mass spectrometry analysis process does not need to be stopped for changing ion sources or loading different analyte samples into the different ion sources. Rather, the different analyte samples can first be loaded into the different ion sources and then the mass spectrometry analysis process can begin while operating the different ion sources in a sequential or parallel fashion. In another aspect, various embodiments of the invention can receive input samples from one or more ion sources and provide the input samples to two or more downstream devices in a parallel or sequential fashion.

Referring now to FIG. 1, shown therein is a block diagram of an exemplary embodiment of a conventional mass spectrometer system 10 including an ion source 12, an ion-focusing device 14, a mass analyzer 16 and a detector 18. Various pumps and power supplies (not shown) are also used in the mass spectrometer system 10 as is commonly known by those skilled in the art.

The ion source 12 provides analyte ions from a trace substance that requires analysis. A variety of devices may be used for the ion source 12 such as an electrospray ion source, a MALDI ion source, and the like. The ion-focusing element device 14, which is typically a quadrupole ion guide, receives the analyte ions from the ion source 12 and focuses and guides the ions to the mass analyzer 16. A quadrupole ion guide includes four elongated conducting rods that are subjected to an RF voltage having a suitable magnitude and frequency (typically 1 MHz) for guiding the analyte ions to the next downstream device. The RF field creates a potential well that provides radial confinement of the ions. The ion-focusing device 14 may operate at an elevated pressure (in the mTorr range for example) and may perform other tasks such as collisional cooling and pressure reduction. Other configurations for the ion guide may also be used such as a hexapole ion guide, an octapole ion guide or stacked rings and the like.

In each of the embodiments discussed herein, the ion-focusing guide 14 may more generally be considered to be an "ion preparation device" which processes the analyte ions. For instance, the ion preparation device may include a combination of both a collision cell to create fragment ions from analyte ions of interest and an ion guide to focus and transmit these fragment ions to the downstream mass analyzer 16.

The mass analyzer 16 may be a mass filter that selects ions having various mass-to-charge ratios. This is achieved by varying parameters of the DC and RF voltages that are applied to the mass analyzer 16 depending on the mass range of interest. Alternatively, the mass analyzer 16 may be any suitable mass analyzer such as a linear quadrupole mass analyzer, a linear or reflecting TOF mass analyzer, a magnetic sector analyzer, and the like. The selected ions are then sent to the detector 18 for detection and measurement. Various devices may be used for the detector as is well known to those skilled in the art.

Quadrupoles that are used in mass spectrometers, and therefore subjected to both RF and DC voltages, require stringent length and machining requirements. For instance, these rods are made of metallized ceramic, have a length of 20 cm or more and roundness tolerances better than 0.5 micrometers and straightness tolerances better than 2.5 micrometers. However, quadrupoles that operate as ion guides which are typically subjected only to RF voltages, have relaxed machining requirements and can be as short as 2.4 cm.

Figure 2:
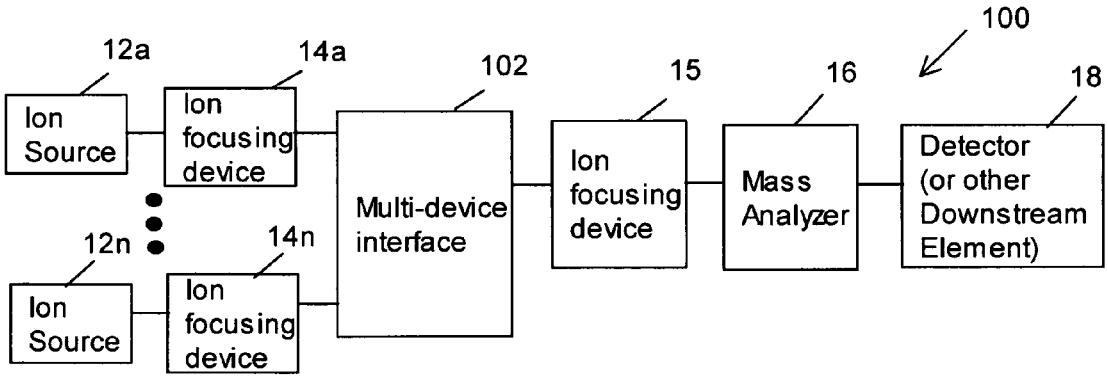
FIG. 2 is a block diagram of an exemplary embodiment of a mass spectrometer system having a multi-device interface in accordance with the invention.

The conventional embodiment shown in FIG. 1 is connected to a single ion source 12 which is not an optimal configuration since the entire mass spectrometer system 10 must be shut down if a different ion source is to be connected. Referring now to FIG. 2, shown therein is a block diagram of an exemplary embodiment of a mass spectrometer system 100 having a multi-device interface 102 in accordance with the invention. The mass spectrometer system 100 is similar to mass spectrometer system 10 except that several ion sources 12*a*-12*n* and ion focusing devices 14*a*-14*n* are connected to the multi-device interface 102. Further, the multi-device interface 102 is connected to the ion focusing device 15. The remainder of the system 100 is similar to the system 10. Each of these components are connected to one another using techniques that are well known to those skilled in the art. For instance, some of these devices may be bolted to one another. The multi-device interface 102 enables simultaneous operation of the multiple ion sources 12*a*-12*n* and does not limit the type of ion sources that can be simultaneously used provided that the different ion sources operate generally under similar circumstances such as the interface pressure and the like. The ion focusing devices 14*a*-14*n* and 15 are optional since, in some embodiments, the multi-device interface 102 can also provide ion focusing. For instance, if a multipole is used in the multi-device interface 102, then the length of the multipole may be selected to be long enough to provide sufficient ion cooling and focusing. The length of the rod sets depends on operating pressure and the initial energy of the generated ions (an exemplary design methodology is described in U.S. Pat. No. 4,963,736 which is hereby incorporated by reference).

Figure 3A:
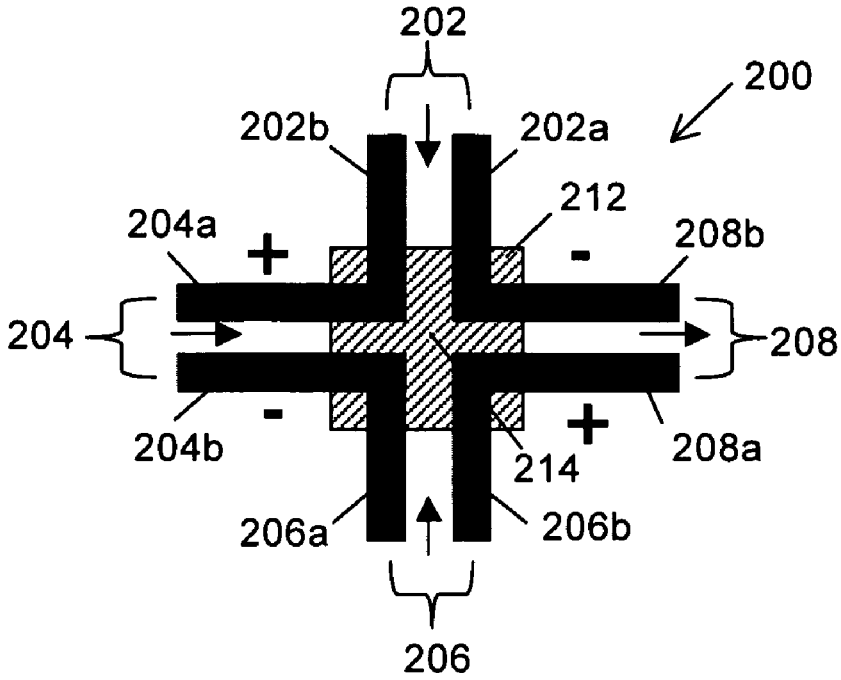
FIG. 3*a* is a top view of a schematic of an exemplary embodiment of the multi-device interface of FIG. 2.
Figure 3B:
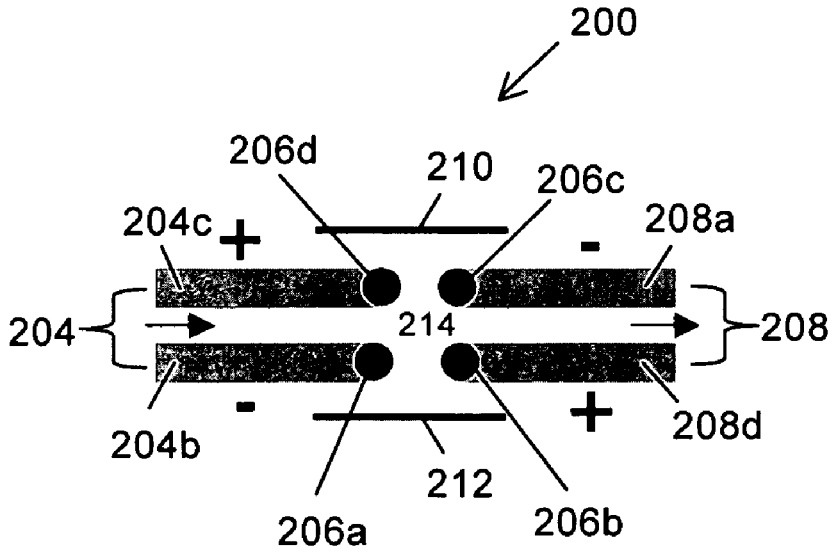
FIG. 3*b* is a side view of a schematic of the multi-device interface of FIG. 3*a;*

Referring now to FIGS. 3*a* and 3*b*, shown therein are top and side views, respectively, of a schematic of one exemplary embodiment of a multi-device interface 200 in accordance with the invention. The multi-device interface 200 includes three input rod sets 202, 204 and 206 and an output rod set 208. The input and output rod sets may also be referred to as input and output multipole rod sets. More generally speaking, an input rod set may be considered to be an inlet pathway and an output rod set may be considered to be an outlet pathway. The multi-device interface 200 has a somewhat planar or two-dimensional configuration since the rod sets 202, 204, 206 and 208 are generally disposed in the x or y direction. The multi-device interface 200 also includes a pair of electrodes 210 and 212, which may be in the form of plates or some other suitable form, for preventing analyte ions from escaping the multi-device interface 200 (FIG. 3*a* does not show electrode 210 in order to show the structure of the interface 200). The output rod set 208 is connected to a downstream device, which in this example is the ion-focusing device 14. The multi-device interface 200 is enclosed within a housing (not shown).

Each rod set of the multi-device interface 200 has a generally square-shaped quadrupolar configuration. This can be seen in FIG. 3*b* by viewing the rod set 206. It is possible to leave gaps between the rod sets that are adjacent to each other. However, in one implementation, adjacent rods are subjected to the same potential so the adjacent rods may touch one another as shown in FIG. 3*a*.

In another implementation, a multi-axis rod having multiple longitudinal axes (in this example, two axes) may be used to provide two quadrupole rods for adjacent pairs of the rod sets 202, 204, 206 and 208. The term multi-axis indicates that the multi-axis rod has two rod portions and a junction portion. The junction portion connects the two rod portions to one another. Each rod portion is substantially linear and the longitudinal axis of the rod portions are not collinear with respect to one another. In this particular example, the multi-axis rod has an L-shape with a general two-dimensional configuration. The junction portion of the L-shaped rod may have an approximate 90-degree bend. Alternatively, the bend may include a smooth radius of curvature (see FIG. 3*c*). The degree of curvature may be determined through simulation or experimentation. The degree of curvature is preferably selected for providing a smooth transition between the electromagnetic fields near the outlet of the input rod sets 202, 204 and 206, in the combination area 210 and near the inlet of the output rod set 208.

In this exemplary embodiment, three ion sources 12*a*-12*c* can be connected to the inlet areas of the input rod sets 202-206. The arrows in FIG. 3*a* indicate the direction of ion traffic. In operation, the ion sources 12*a*-12*c* generate ions and appropriate RF potentials are applied to the input rod sets 202-206 to guide the analyte ions from the inlet area to an outlet area of each input rod set 202-206. The analyte ions are then led to a combination area 214 where the analyte ions from the different ion sources 12*a*-12*c* are combined to form combined ions. The combined ions in the combination area 214 then travel from the inlet portion to the outlet portion of the output rod set 208 and then into the adjacent downstream device.

Ion movement along the axis of a given rod set may be due to ion diffusion, gas flow, electric fields imposed along the axis or space charge. The axial fields can be created by field penetration from electrodes located outside of the rod sets, or by a variety of means that are described in U.S. Pat. No. 6,111,250 which is hereby incorporated by reference. These methods of moving the ions can be used to ensure that ions move efficiently and quickly through the input and output rod sets in the direction that is desired.

In general, ion traffic is controlled by the electric fields and/or gas flows at the entrance and exit of each rod set. The ions are also confined radially by the effective potential created by the RF-field. The magnitude and frequency of the RF potentials applied to the rod sets 202-208 can be chosen depending on the nature of the analyte ions provided by each ion source 12*a*-12*c*. RF potentials are applied to a pair of adjacent rods in a given rod set as indicated in FIGS. 3*a* and 3*b* in which "−" and "+" signs indicate that a rod is connected to a particular terminal of the RF power supply. Furthermore, at the entrance or exit of a given rod set, there is a voltage drop of a few volts or tens of volts that also defines the direction in which the generated ions travel. For example, some ions from rod set 202 may enter the outlet area of rod set 206, but those ions will not exit from the inlet area of rod set 206. Instead, the direction of travel of these "wayward" ions will generally reverse and the wayward ions will eventually travel to the combination area 214 in general due to ion diffusion and voltage drops. In addition, in other cases, there may be an Atmospheric Pressure ion source, such as an electrospray ion source, at the entrance of the input rod set 204, which provides a weak flow of gas along the common axis of rod sets 204 and 208, which assists in guiding ions from input rod sets 202 and/or 206 in the direction towards the outlet area of rod set 208. Gas flow may also be introduced artificially, either just to maintain a pressure greater than approximately 1 mTorr or to create a directional flow. Those skilled in the art will know where to position the pump.

The pair of blocking electrodes or blocking plates 210 and 212 have been added to prevent analyte ions from escaping the combination area 214 since there is a gap in this region where the input rod sets 202-206 and the output rod set 208 meet one another and the RF-field is weaker there. The blocking electrodes 210 and 212 may be vertically spaced away from the upper and lower surfaces of the upper and lower rods, respectively, of the rod sets 202-208 by about 1 to 50 mm and more preferably by about 1 to 10 mm.

Blocking plates, or other types of electrodes, can also be used when an ion source is not connected to one of the input rod sets 202-206. For example, if an ion source is not connected to the input rod set 202, then an additional electrode or blocking plate (not shown) can be placed in close proximity to the entrance of the input rod set 202 and an appropriate potential applied to the blocking plate to prevent ions from the other ion sources from escaping at the entrance of the unused input rod set 202. The blocking electrode can also be implemented by a rod or plate that penetrates inside the entrance of an unused input rod set. The rod or plate can be vertically or horizontally positioned or cross-positioned between the rods of the unused input rod set. Assuming that the analyte ions are cooled down in collisions, then in some cases 1 V DC may be enough to block the entrance of an unused input rod set. However, larger voltages, such as 5 to 50 V DC, may also be applied to the blocking plate. In an alternative, a gas flow may be used either alone or in combination with a blocking electrode for an unused input rod set to prevent ions from escaping from the multi-device interface 102.

The blocking potential applied to electrodes at the entrances of unused input rod sets do not penetrate deep enough into the input rod sets to affect the ion motion through the combination area. For this reason a wide range of voltages can be applied to blocking electrodes at the entrances of unused input rod sets, from approximately 1 to 20 V or even 50 V DC. On the other hand, the potentials from the blocking plates 210 and 212 penetrate into the combination area 214 and, if too large, may create a potential barrier that blocks ion motion through the combination area 214. Therefore, the range of voltages applied to the blocking plates 210 and 212 is typically smaller, i.e. 0.2 to 5 V and possibly up to 10 V DC in some cases depending on the size of the combination area 214 and how close the blocking plates are to the upper and lower portions of the combination area 214.

Figure 3C:
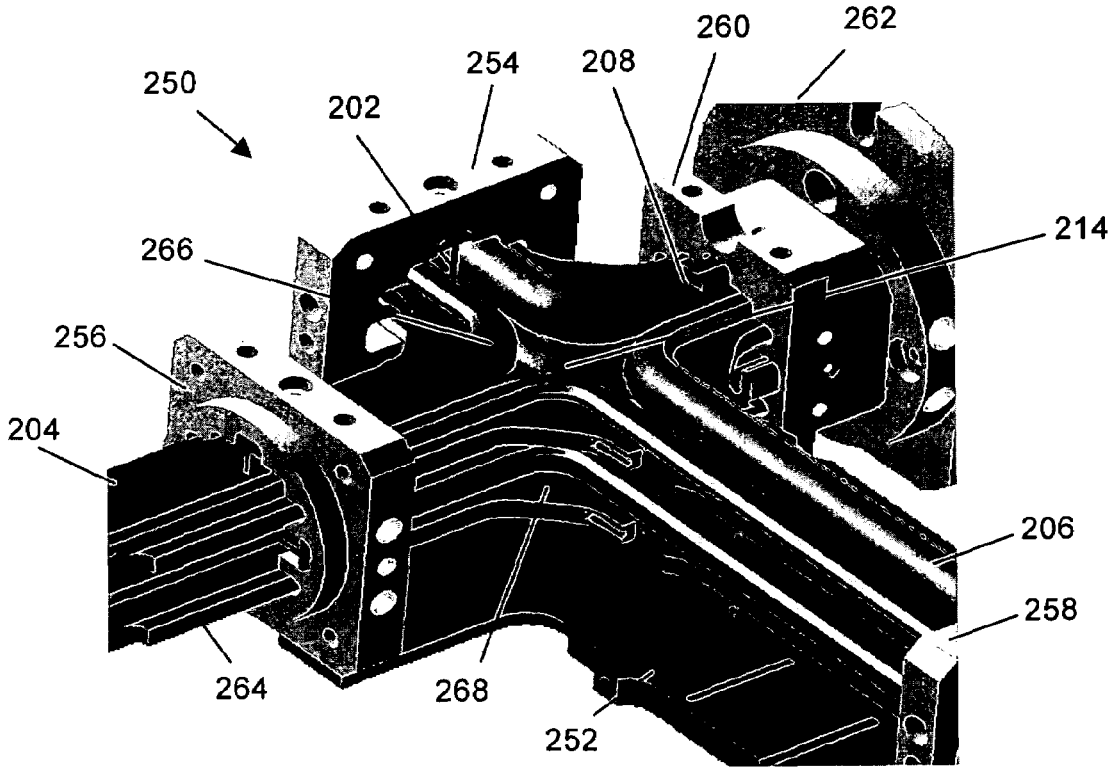
FIG. 3*c* is an isometric view of an exemplary implementation of the multi-device interface of FIG. 3*a;*

Referring now to FIG. 3*c*, shown therein is an isometric view of an exemplary implementation of a multi-device interface 250. The multi-device interface 250 includes a blocking plate 252, support members 254-260 and a connection port 262. Other connection ports (not shown) are also included for connection to the various ion sources. The multi-device interface 250 also includes a housing which has not been shown in FIG. 3*c* so that the inner structure of the multi-device interface 250 can be seen. The connection port 262 is used to connect the multi-device interface 250 to a downstream device. The support members 254-260 are used to mount the housing for the multi-device interface 250. Element 262 indicates a portion of a downstream device.

In this exemplary implementation, multi-axis rods having a general two-dimensional L-shape are used to provide one rod for two adjacent rod sets. Reference labels generally indicate rods belonging to the rod sets 202-208. Each multi-axis rod has a junction portion (only one of which 266 is labeled for simplicity). The rod portions of each multi-axis rod may be provided with a flange (as shown) that engage a corresponding groove or bracket within each support member 254-260 to hold the rod in place; for example flange 264 is labeled for one of the rods of rod set 204. Alternatively, flanges may not be provided on the rods and the inner portions of the support members 254-260 may have a groove shape to accommodate the outer surface of the rods. Some of the rods may also have tapered portions to physically accommodate a particular orientation for an ion source.

The inventors have found that the removal of sharp edges or bends in the junction portion 268 of the multi-axis rods helps to keep electric field lines "smooth" near the outlet of the input rod sets 202-206, near the input of the output rod set 208 and in the combination area 214 and thus preserve "smooth" ion motion in these regions. Therefore, the multi-axis rods may generally employ a radius of curvature in the junction portion. On the other hand, employing too large a radius of curvature may not be preferable since this may produce a gap in the combination area 214 that may be too large and may weaken the radial potential well that keeps ions close to the axis of each ion rod set 202-208.

Figure 4A:
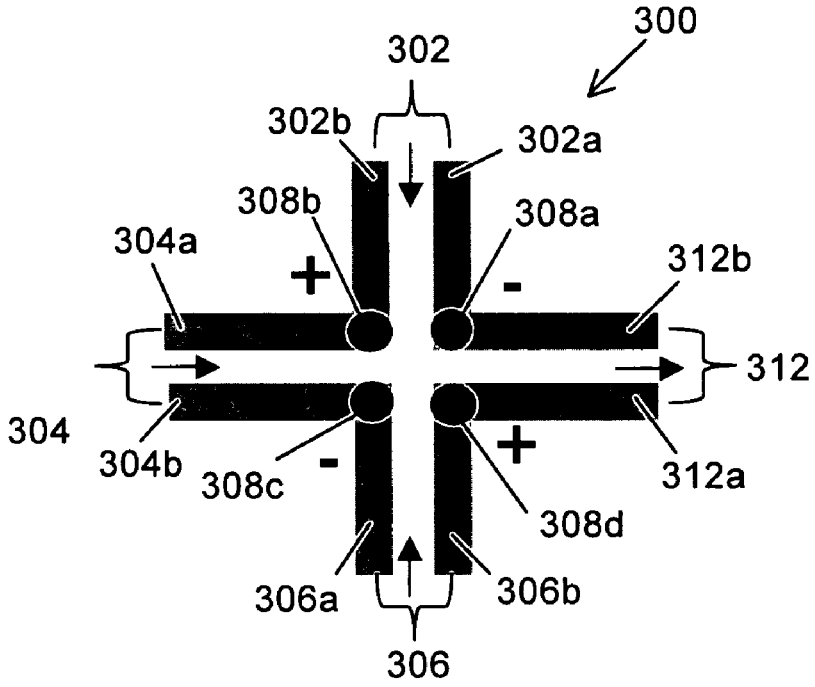
FIG. 4*a* is a top view of a schematic of another exemplary embodiment of the multi-device interface of FIG. 2.
Figure 4B:
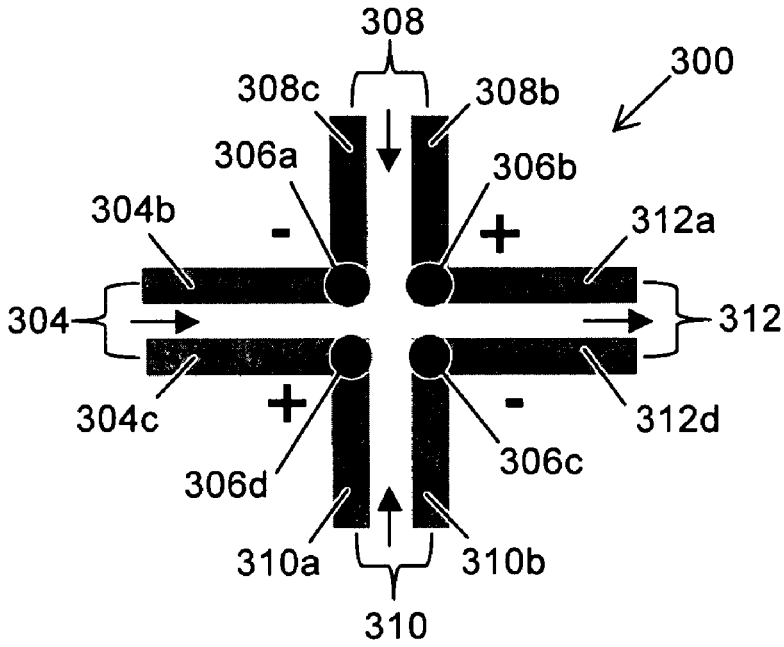
FIG. 4*b* is a side view of the multi-device interface of FIG. 4*a;*

Referring now to FIGS. 4*a* and 4*b*, shown therein are top and side views, respectively, of another exemplary embodiment of a multi-device interface 300 in accordance with the invention. The multi-device interface 300 generally has a three-dimensional configuration with rod sets being generally disposed in the x, y or z directions. The multi-device interface 300 includes five input rod sets 302-310, an output rod set 312 and a combination area 314. Accordingly, the multi-device interface 300 may be connected to up to five different ion sources 12*a*-12*n*. Since there is an input rod set along each x-y-z direction in the multi-device interface 300, there is no gap over/under the combination area 314 as there was for the multi-device interface 200 and hence no need for any electrode plates covering this region. Also, the configuration of the multi-device interface 300 is somewhat similar to that of the multi-device interface 200 in that each rod set has a generally square-shaped quadrupolar configuration. Otherwise, the multi-device interface 300 operates similarly to the multi-device interface 200. For instance, blocking electrodes (not shown) are still required for each unused input rod set. Further, rather than employing 90 degree angles between the rods of adjacent rod sets, a radius of curvature may be preferably used as was done for the multi-device interface 250 (see FIG. 3*c*).

In addition, the rods of adjacent rod sets may be connected to one another. For instance, with respect to rod sets 302-310, rods 302*b*, 304*a*, 308*b*, and 310*d* (not shown) may be connected to one another. To implement this, a multi-axis rod with four linear rod portions and a single junction portion may be used.

Figure 5A:
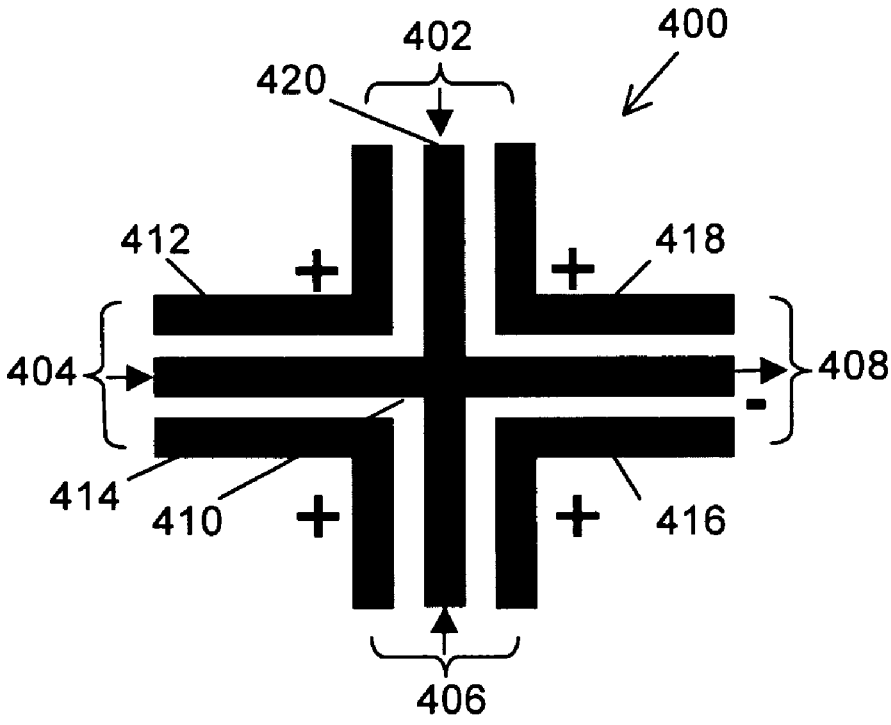
FIG. 5*a* is a top view of a schematic of another exemplary embodiment of the multi-device interface of FIG. 2.
Figure 5B:
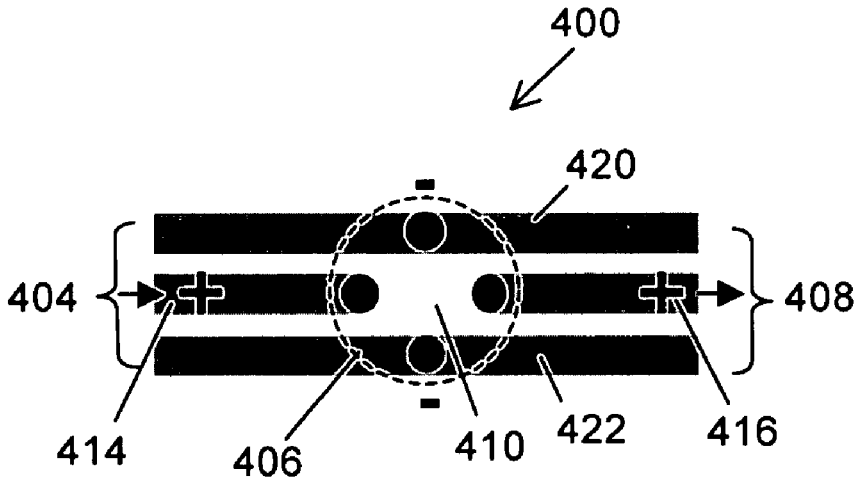
FIG. 5*b* is a side view of a schematic of the multi-device interface of FIG. 5*a;*

Referring now to FIGS. 5*a* and 5*b*, shown therein are top and side views, respectively, of a schematic of another exemplary embodiment of a multi-device interface 400 in accordance with the invention. The multi-device interface 400 has a general two-dimensional configuration with rod sets being generally disposed in the x or y directions. The multi-device interface 400 includes three input rod sets 402-406, an output rod set 408 and a combination area 410. Accordingly, the multi-device interface 400 may be connected to up to three different ion sources 12*a*-12*c*. Each rod set of the multi-device interface 400 also has a generally diamond-shaped quadrupolar configuration (this can be seen by observing the end profile of input rod set 406 in FIG. 5*b*).

In one implementation, the multi-device interface 400 may be made from multi-axis rods 412-418 which are generally L-shaped and multi-axis rods 420 and 422 which are generally X-shaped or cross-shaped. The multi-axis rods 420 and 422 are the top-most and lower-most rods respectively. The multi-axis rods 412-418 are placed vertically mid-way between the multi-axis rods 420 and 422 and in a separate one of the four quadrants defined by the multi-axis rods 420 and 422. Rods 412-418 may be referred to as mid-level rods. Once again, the bends of the junction portions of each of the multi-axis rods 412-422 may have a radius of curvature as was used in the multi-source interface 250 (see FIG. 3*c*).

The multi-device interface 400 does not have a gap over or underneath the combination area 410 due to the use of the cross-shaped multi-axis rods 420 and 422. Accordingly, there is no need for any blocking electrodes in this area to prevent ions from escaping the multi-device interface 400. However, blocking electrodes are still required for any input rod set that is unused. Otherwise, the multi-device interface 400 operates similarly to the multi-device interface 200.

Figure 6A:
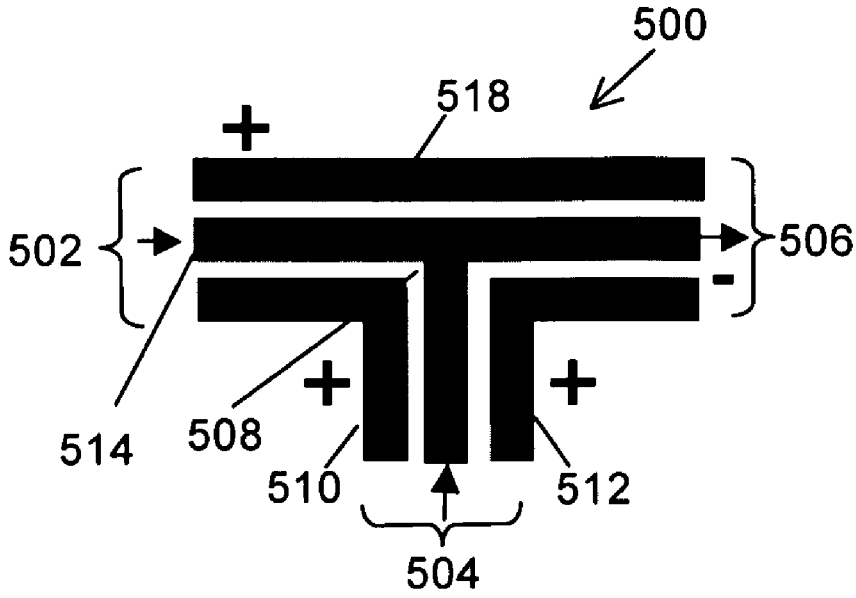
FIG. 6*a* is a top view of a schematic of another exemplary embodiment of the multi-device interface of FIG. 2.
Figure 6B:
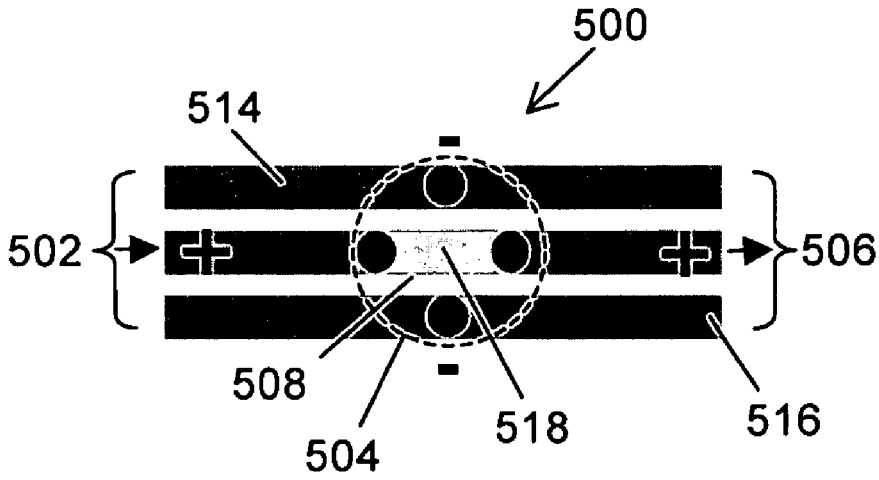
FIG. 6*b* is a side view of a schematic of the multi-device interface of FIG. 6*a;*

Referring now to FIGS. 6*a* and 6*b*, shown therein are top and side views, respectively, of a schematic of another exemplary embodiment of a multi-device interface 500 in accordance with the invention. The multi-device interface 500 generally has a two-dimensional configuration with rod sets being generally disposed in the x or y directions. The multi-device interface 500 includes two input rod sets 502 and 504, an output rod set 506 and a combination area 508. Accordingly, the multi-device interface 500 may be connected to up to two different ion sources 12*a*, and 12*b*. The multi-device interface 500 also has a generally diamond-shaped quadrupolar configuration. However, in one implementation, the multi-device interface 500 may be made from two multi-axis rods 510 and 512 generally having an L-shape, two multi-axis rods 514 and 516 generally having a T-shape, and a straight rod 518. The multi-axis rods 514 and 516 are the top-most and lower-most rods respectively. The multi-axis rods 510 and 512 are placed vertically mid-way between, and to one side of the multi-axis rods 514 and 516, while the straight rod 518 is placed vertically midway between the multi-axis rods 514 and 516 and to the other side of the multi-axis rods 514 and 516 opposite the multi-axis rods 510 and 512. Rods 510, 512 and 518 may be referred to as mid-level rods. The multi-device interface 500 also does not have a gap over or underneath the combination area 508 due to the use of the multi-axis rods 514 and 516. Accordingly, there is no need for any blocking electrodes in this area to prevent ions from escaping the multi-source interface 500. Otherwise, the multi-device interface 500 operates similarly to the multi-device interface 200. Once again, rather than having 90 degree angles at the junction portion of multi-axis rods 510-516, it is generally preferable to employ a radius of curvature as was done for the multi-device interface 250 (see FIG. 3*c*). Furthermore, a blocking electrode and or gas flow is needed for any unused input rod set.

Figure 7:
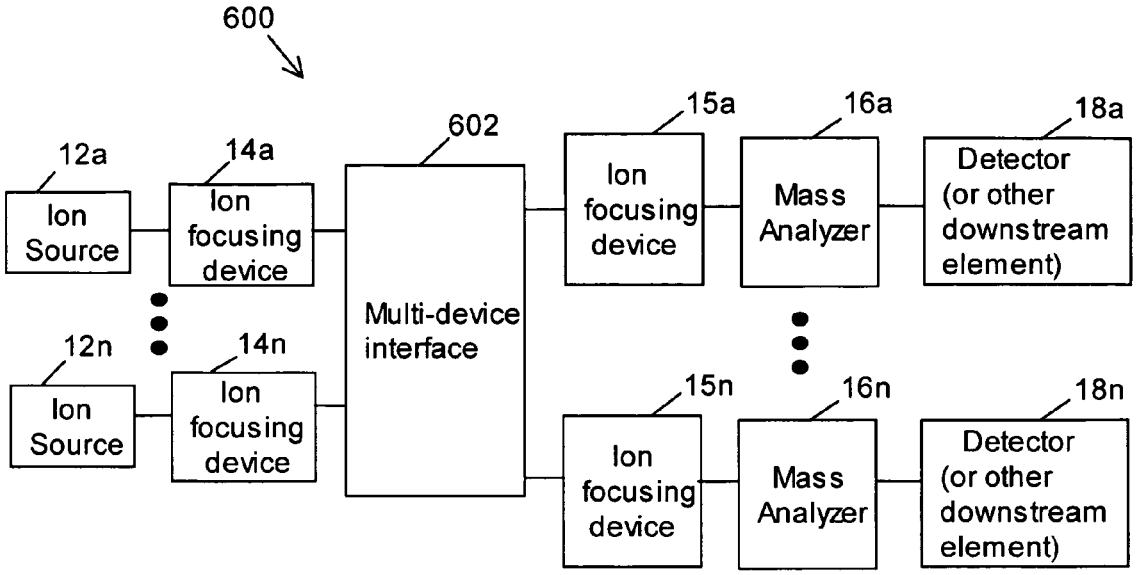
FIG. 7 is a block diagram of another exemplary embodiment of a mass spectrometer system having a multi-device interface configured in a different fashion for providing multiple outputs in accordance with the invention.

In some cases it may be necessary to provide analyte ions to more than one downstream device for analysis. In this case, two or more of the multipole rod sets are configured as output rod sets. Referring now to FIG. 7, shown therein is a block diagram of an exemplary embodiment of a mass spectrometer system 600 having a multi-device interface 602 in accordance with the invention. The multi-device interface 602 is connected to ion sources 12*a*-12*n* via ion focusing devices 14*a*-14*n*. The multi-device interface 602 is also connected to mass analyzers 16*a*-16*n* (or other suitable downstream elements used for mass spectrometry analysis) via ion focusing devices 15*a*-15*n*. Detectors 18*a*-18*n* may also be employed depending on the type of mass analyzers 16*a*-16*n* that are used. It should be noted that ion focusing devices 14*a*-14*n* are optional as are ion focusing devices 15*a*-15*n* since the rod sets of the multi-device interface 602 may provide ion focusing. It should be noted that the general layout shown in FIG. 7 may further be varied. For instance, there may only be one ion source and two or more chains of downstream elements connected to the multi-device interface 602. In the single input case, the combination area of the multi-device interface 602 acts as a transition area, rather than a combination area, in which the generated ions are sent to two or more chains of downstream elements. A given rod set may be configured as an input rod set or an output rod set depending on the values of the potentials that are applied to the given rod set and the device that it is connected to (i.e. an ion source or a downstream element).

Advantageously, the various embodiments of the multi-device interface previously described may be used to connect one or more input sources to one or more downstream devices. This can be done without having to make any major modifications to the interface other than possibly having to physically adjust an output rod set to ensure that it physically connects properly to a downstream device. The potentials applied to a given rod set, in relation to potentials applied to the other rod sets, dictate whether the given rod set is configured as an input rod set or as an output rod set. Multiple exits can be gated by applying an appropriate electric field in a somewhat similar fashion as was described for the various embodiments of interfaces that were attached to multiple input sources.

Although there can be several outputs, each output does not have to be working simultaneously. One possible application of the multi-device interface 602 may be the case in which one or more ion sources provide ions for two different mass analyzers. This is particularly applicable if one of the mass analyzers is more suitable for single MS analysis, while the other mass analyzer is more suitable for MS/MS analysis.

The various exemplary embodiments of the multi-device interface may be altered in different ways. For instance, rather than using only quadrupoles for the rod sets, hexapoles or octapoles may also be used. For instance, quadrupoles may be connected to hexapoles or octapoles and hexapoles may also be connected to hexapoles. Some exemplary embodiments of these configurations are discussed below. In general, there may be some embodiments of the multi-device interface in which N quadrupoles may be connected to a 2N multipole.

Figure 8A:
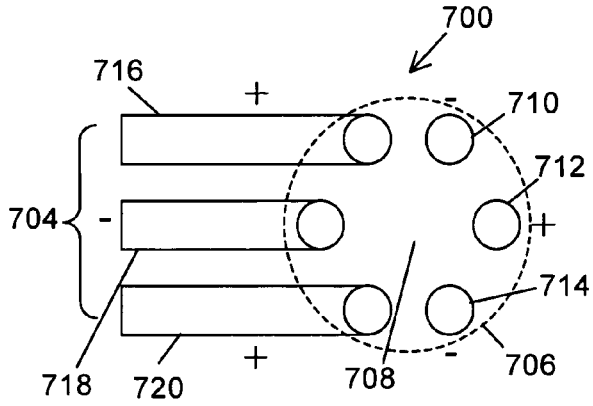
FIGS. 8*a* and 8*b* are respectively end and side views of a schematic of an exemplary embodiment of a multi-device interface implemented with a quadrupole rod set and two hexapole rod sets.
Figure 8B:
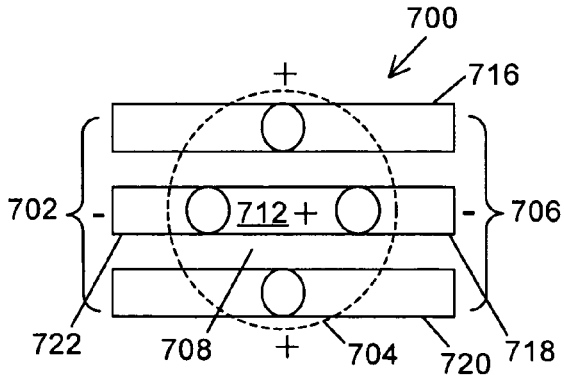

Referring now to FIGS. 8*a* and 8*b*, shown therein is an end view and a side view, respectively, of an alternative embodiment of a multi-device interface 700 which corresponds to the configuration of multi-device interface 500. The multi-device interface 700 includes rod sets 702, 704 and 706. Rod set 704 is implemented with a quadrupole rod set and rod sets 702 and 706 are implemented with hexapole rod sets. Reference numeral 708 indicates the location of the combination area which is generally in the middle of the multi-device interface 700. In one implementation, the multi-device interface 700 may be made with straight rods 710, 712 and 714 and multi-axis rods 716, 718, 720 and 722 in which multi-axis rods 716 and 720 generally have a T-shape and multi-axis rods 718 and 722 generally have an L-shape. Appropriate RF potentials are applied with polarities as shown to guide the generated ions to the one or more output rod sets. Gas flow in one or more of the rod sets may also be used to facilitate ion transport. Blocking electrodes and/or gas flow may also be used for any unused input or output rod sets. Further, in a similar fashion as shown in these figures, one quadrupole may be attached to any 2N-multipole.

Figure 9A:
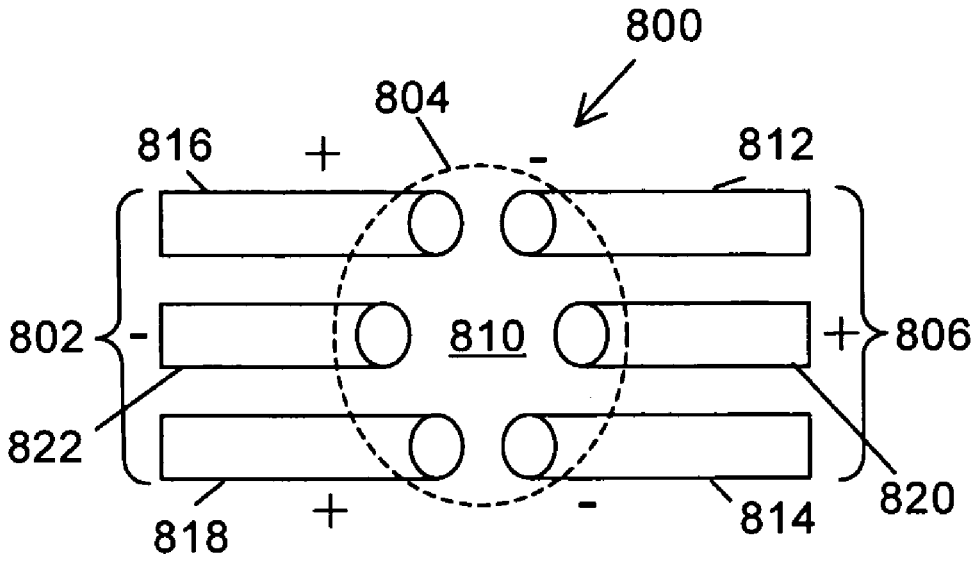
FIGS. 9*a* and 9*b* are respectively front and side views of a schematic of an exemplary embodiment of a multi-device interface implemented with two quadrupole rod sets and two hexapole rod sets.
Figure 9B:
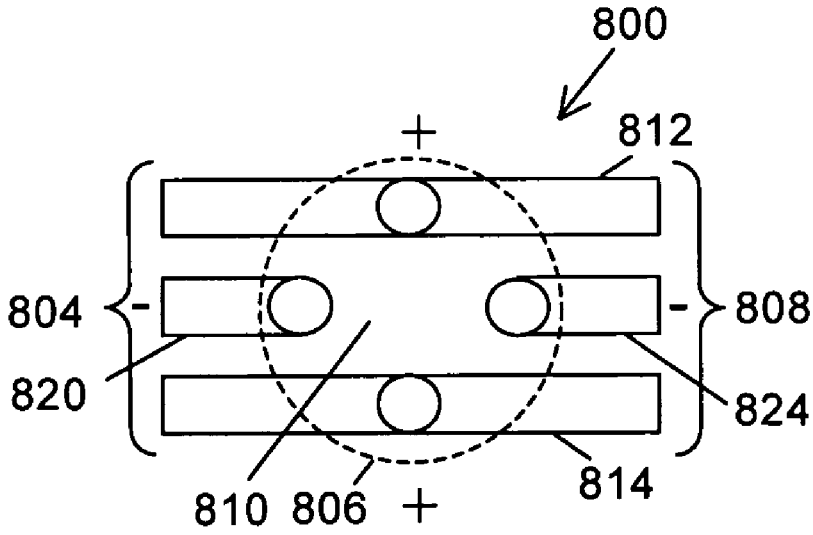

Referring now to FIGS. 9*a* and 9*b*, shown therein are front and side views, respectively, of an alternative embodiment of a multi-device interface 800 which corresponds to the configuration of multi-device interface 200. The multi-device interface 800 includes rod sets 802, 804, 806 and 808. Reference numeral 810 indicates the location of the combination area which is generally in the middle of the multi-device interface 800. Rod sets 802 and 806 are implemented with quadrupoles and rod sets 804 and 808 are implemented with hexapoles. In one implementation, the multi-device interface 800 may be made from multi-axis rods 812-824 in which multi-axis rods 812-818 generally have a T-shape and multi-axis rods 820-824 generally have an L-shape (one of the L-shaped multi-axis rod is not visible in FIGS. 9 and 9*b*). Appropriate RF potentials are applied with polarities as shown to guide the generated ions to the one or more output rod sets. Gas flow in one or more of the rod sets may also be used to facilitate ion transport. Blocking electrodes and/or gas flow may also be used for any unused input or output rod sets. Further, in a similar fashion as shown in these figures, two quadrupoles may be attached to an octapole. In general, three or more quadrupoles may be attached to a 2N multipole where N>4.

Figure 10A:
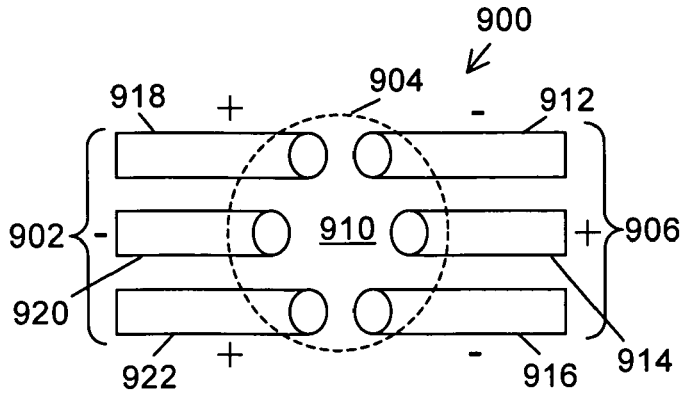
FIGS. 10*a* and 10*b* are respectively front and side views of a schematic of an exemplary embodiment of a multi-device interface implemented with four hexapole rod sets.
Figure 10B:
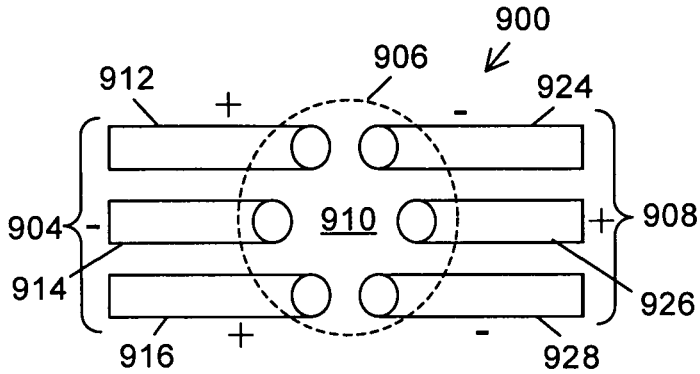

Referring now to FIGS. 10*a* and 10*b*, shown therein are front and side views, respectively, of an alternative embodiment of a multi-device interface 900 which corresponds to the configuration of multi-device interface 200. The multi-device interface 900 includes rod sets 902, 904, 906 and 908 that are implemented via hexapoles. Reference numeral 910 indicates the location of the combination area which is generally in the middle of the multi-device interface 900. In one implementation, the multi-device interface 900 may be made from multi-axis rods 912-928 generally having an L-shape (three of the L-shaped multi-axis rods are not visible in FIGS. 10*a* and 10*b*). Appropriate RF potentials are applied with polarities as shown to guide the generated ions to the one or more output rod sets. Gas flow in one or more of the rod sets may also be used to facilitate ion transport. Blocking electrodes and/or gas flow may also be used for any unused input or output rod sets.

Figure 11:
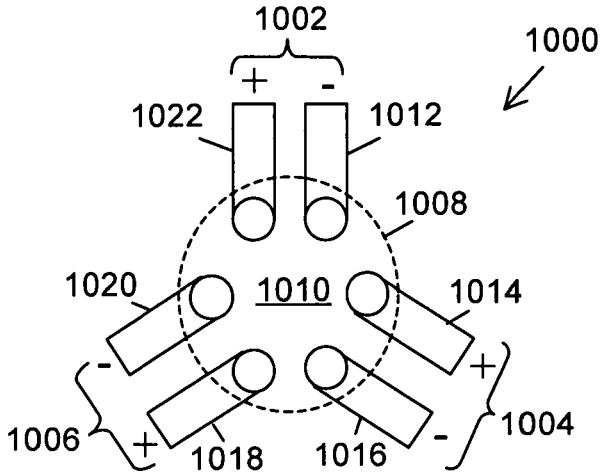
FIG. 11 is a top view of a schematic of an alternative embodiment of a multi-device interface implemented with two hexapole rod sets and three quadrupole rod sets.

Referring now to FIG. 11, shown therein is a top view of an alternative embodiment of a multi-device interface 1000 which corresponds to the configuration of multi-device interface 300. The multi-device interface 1000 includes rod sets 1002, 1004, 1006 and 1008 as well as another rod set that is directly inline with rod set 1008 and not visible. Reference numeral 1010 indicates the location of the combination area which is generally in the middle of the multi-device interface 1000. In one implementation, the multi-device interface 1000 may be made from multi-axis rods 1012-1022 generally having an L-shape (there is another set of multi-axis rods in a mirror configuration to that of, and directly in line with, multi-axis rods 1012-1022 and hence are not visible in FIGS. 11*a* and 11*b*). Once again, appropriate RF potentials are applied with polarities as shown to guide the generated ions to the one or more output rod sets and gas flow in one or more of the rod sets may also be used to facilitate ion transport.

It should be understood that the combination areas described in the various embodiments may more generally be referred to as a transition region in which generated ions from one or more input rod sets move to one or more output rod sets. Further, it should be understood that a blocking electrode and/or gas flow may be used for any multipole rod set that is configured as an output rod set and not connected to a downstream device.

The physical orientation of the various embodiments of the multi-device interfaces disclosed herein enables the simultaneous operation of the ion sources 12*a*-12*n* since there are no physical elements blocking the pathway of each of the input rod sets 202-206 to the combination area 214.

In addition, the entrance portion of each input rod set may include some special physical configuration depending on the ion source to which it is attached. For instance, ion apertures, skimmer cones, etc. may be included with a given ion source and the inlet area of the input rod set which is connected to the given ion source may be reshaped depending on the physical orientation of the ion source. For instance, the leftmost input rod set shown in FIG. 3*c* has tapered rods that are shaped to fit within a conical skimmer. However, there may also be other instances in which the inlet area of the input rod sets may include a physical element such as a skimmer cone and the like. There may also be some instances in which the outlet area of a given rod set may include some special physical configuration. For example, the outlet area of the output rod set 208 may include an orifice plate since this output rod set 208 may be directly connected to a mass analyzer which usually operates under vacuum conditions. The size of the aperture in the orifice plate may be 1-3 mm in diameter for example.

In addition, in other embodiments, there may be cases in which it is advantageous to provide different rod thicknesses for different rod sets. The output rod set may also have different sizes for the rods as well as different operating voltages since it is receiving ions from several ion sources.

The operating pressure of each of the multi-device interfaces of the invention described herein depend to some extent on collisional cooling of the analyte ions in each input rod set. The inventors have found that the lower limit for operating pressure is approximately 1 mTorr while the upper limit may be as high as 3 Torr. However, an upper limit of 1 Torr is more preferable. A more preferable pressure range may be 5 to 100 mTorr. This pressure range is independent of the type of analyte ions that are provided by the different ion sources. However, the lower end of the pressure range is dictated by the requirement of cooling ions while the higher end of the pressure range is dictated by the requirement of RF-confinement of the generated ions. The lower pressure limit is chosen to bring the generated ions to almost thermal energies so that the generated ions may make the required turn to the combination area and then into an output rod set; this is done through collisional cooling which requires a certain amount of gas to be present in the multi-device interface. For instance, selecting a pressure less than 1 mTorr would require that the length of the rod set to be more than 1 meter to provide collisional cooling of the generated ions which may not be very practical in some cases. Further, selecting pressures larger than 2-3 Torr may result in the RF-field not providing sufficient containment for the generated ions.

Each of the embodiments of the multi-device interface of the invention may be used with ion sources that can work at pressures of 1 mTorr or higher. This includes all types of electrospray ion sources, all types of atmospheric pressure (AP) ionization sources such as AP MALDI ion sources, AP chemical ionization ion sources, AP photoionization ion sources, and the like. Also the ion sources may include MALDI ion sources operating at pressures lower than atmospheric pressure, and electron impact and chemical ionization ion sources.

For each of the multi-device interfaces of the invention, the magnitude and frequency of the RF voltages that are applied to the rod sets are dependent on the range of the ion mass-to-charge ratio that is to be transmitted. For instance, in RF-quadrupoles, as is commonly known to those skilled in the art, the low mass cut-off is proportional to the amplitude of the applied RF-voltage. For each embodiment, a DC offset voltage is also applied to the rods of each rod set to attract ions from an ion source into the combination area and to direct the ions out towards the output rod set. Normally, an offset voltage of only a few volts DC is required. The polarity of the offset voltage is selected depending on whether the generated ions are positive or negative.

For each of the embodiments of the multi-device interface of the invention, the diameters of each of the rods in the rod sets may vary from about 2 mm to 2 cm. Those skilled in the art will understand how to correctly select a diameter for the rods in each of the rod sets.

The multi-device interface of the invention can be applied to any type of mass spectrometer that normally utilizes multipole or stacked ring ion guides operating at the pressure range given above. This may include quadrupoles, triple quadrupoles, linear ion traps, time-of-flight mass spectrometers with axial or orthogonal injection, Fourier Transform Ion Cyclotron Resonance (FT ICR) and various tandem combinations thereof.

Figure 12:
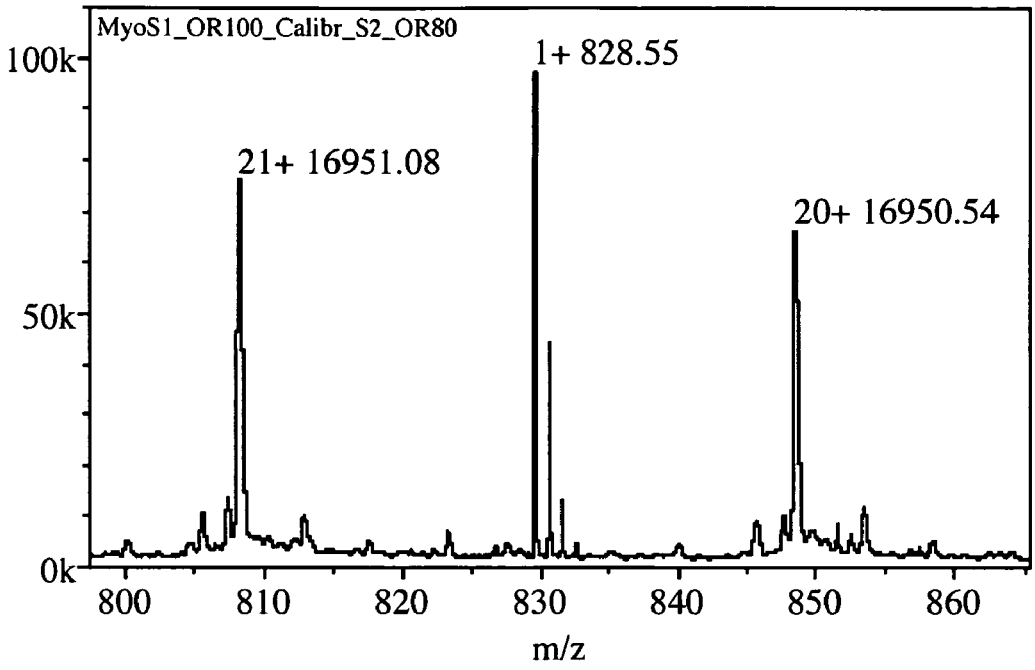
FIG. 12 is a segment of a mass spectrum recorded when two electrospray ion sources were connected to a multi-device interface having the configuration shown in FIGS. 3*a* and 3*b* and operated simultaneously; and, FIG. 13 is a segment of a mass spectrum recorded when electrospray and MALDI ion sources were connected to a multi-device interface having the configuration shown in FIGS. 3*a* and 3*b* and operated simultaneously.

Referring now to FIG. 12, shown therein is a segment of a mass spectrum recorded when two electrospray ion sources were connected to a multi-device interface having the configuration shown in FIGS. 3*a* and 3*b* and operated simultaneously. A solution of the protein myoglobin was delivered to one of the ion sources while the peptide ALILTLVS was used as a calibrant and provided to the other ion source. The results show that the multi-device interface of the invention enables simultaneous operation of multiple ion sources which allows an analyte to be provided by one ion source and a calibrant to be simultaneously provided by another ion source. The analyte spectrum can thus be simultaneously calibrated for better mass accuracy. The numbers near the peaks in FIG. 12 indicate charge and mass respectively.

Figure 13:
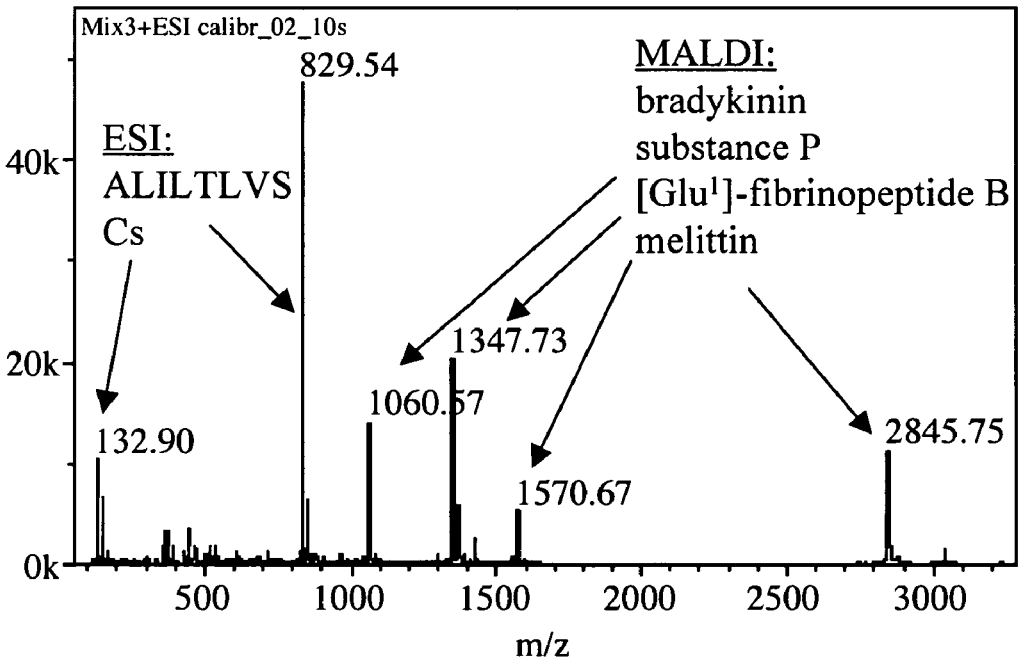

Referring now to FIG. 13, shown therein is a segment of a mass spectrum recorded when electrospray and MALDI ion sources were connected to a multi-device interface having the configuration shown in FIGS. 3*a* and 3*b* and operated simultaneously. The MALDI source was operating at an elevated pressure of 7 mTorr and the electrospray ionization source was operating at atmospheric pressure. A calibration solution was loaded into the electrospray ion source that was in-line with the downstream mass analyzer (i.e. connected to rod set 204). A mixture of four peptides was deposited on the plate of the MALDI source which was positioned at an input rod set that was orthogonal with the axis of the downstream mass analyzer (i.e. connected to rod set 206). The third input (i.e. rod set 202) was blocked by a positive potential applied to a blocking electrode. The numbers near the peaks in FIG. 13 indicate the mass-to-charge ratio (m/z) of a given peak.

It should be understood that various modifications can be made to the embodiments described and illustrated herein, without departing from the invention, the scope of which is defined in the appended claims.

The invention claimed is:

1. A multi-device interface for use in mass spectrometry for interfacing one or more ion sources to one or more downstream devices, wherein the multi-device interface comprises:

a) three or more multipole rod sets configured as either an input rod set or an output rod set depending on potentials applied to the multipole rod sets;

wherein, the multipole rod sets that are configured as an input rod set have an inlet portion and an outlet portion, the inlet portion being connectable to one of the one or more ion sources for receiving ions generated therefrom and transmitting the generated ions to the outlet portion; and, wherein, the multipole rod sets that are configured as an output multipole rod set have an inlet portion and an outlet portion, the inlet portion being adjacent to the outlet portion of at least one of the multipole rod sets that are configured as an input rod set to receive and transmit the generated ions to the outlet portion of the output multipole rod set, the outlet portion of the output multipole rod set being connectable to a downstream device; and, wherein, at least two of the multipole rod sets are configured as input rod sets or at least two of the multipole rod sets are configured as output rod sets.

2. The multi-device interface of claim 1, wherein the interface further includes a transition region connecting the outlet portion of the multipoles configured as an input rod set to the inlet portion of the multipoles configured as an output rod set.

3. The multi-device interface of claim 2, wherein the interface has a general planar configuration and the multipole rod sets are disposed along either dimension of the plane.

4. The multi-device interface of claim 3, wherein the multi-device interface includes four multipole rod sets, each of the multipole rod sets having a quadrupolar configuration with a square-shaped end profile, and the interface further includes upper and lower blocking electrodes situated above and below the transition area, and in use, a blocking potential is applied to the upper and lower blocking electrodes to prevent ions from escaping the combination area.

5. The multi-device interface of claim 4, wherein adjacent rods in adjacent multipole rod sets are provided by a multi-axis rod, wherein the multi-axis rod includes two rod portions and a junction portion for connecting the two rod portions.

6. The multi-device interface of claim 5, wherein the junction portion includes a bend having a radius of curvature.

7. The multi-device interface of claim 2, wherein the multi-device interface further includes a blocking electrode, the blocking electrode being adjacent to the inlet portion of an unused input rod set or the blocking electrode being adjacent to the outlet portion of any unused output rod set, wherein, during use, a potential is applied to the blocking electrode to prevent any generated ions from escaping from the unused multipole rod set.

8. The multi-device interface of claim 2, wherein a gas source is connected to the inlet portion of any unused multipole rod set configured as an input rod set that is not connected to any of the one or more ion sources or the gas source is connected to the outlet portion of any unused multipole rod set configured as an output rod set that is not connected to a downstream device wherein, during use, the gas source provides a blocking gas flow to prevent any generated ions from escaping from the unused multipole rod set.

9. The multi-device interface of claim 3, wherein the multi-device interface includes four multipole rod sets, and each of the multipole rod sets have a quadrupolar configuration with a diamond-shaped end profile.

10. The multi-device interface of claim 9, wherein the multi-device interface includes:

a) an upper and a lower multi-axis rod generally having a cross-shape for providing the upper and lower rods in each of the multipole rod sets; and, b) mid-level multi-axis rods generally having an L-shape disposed between the upper and lower multi-axis rods and in each quadrant defined by the cross-shape of the upper and lower multi-axis rods, each mid-level multi-axis rod providing adjacent rods in adjacent rod sets, wherein each mid-level multi-axis rod includes two rod portions and a junction portion for connecting the two rod portions.

11. The multi-device interface of claim 10, wherein the junction portion includes a bend having a radius of curvature.

12. The multi-device interface of claim 2, wherein the multi-device interface includes three multipole rod sets, and each of the multipole rod sets have a quadrupolar configuration with a diamond-shaped end profile.

13. The multi-device interface of claim 12, wherein the multi-device interface includes:

a) an upper and a lower multi-axis rod generally having a T-shape for providing the upper and lower rods in each of the multipole rod sets;

b) mid-level multi-axis rods generally having an L-shape disposed between the upper and lower multi-axis rods and in each quadrant defined by the T-shape of the upper and lower multi-axis rods, each mid-level multi-axis rod includes two rod portions and a junction portion for connecting the two rod portions; and, c) a mid-level straight rod disposed between the upper and lower multi-axis rods and opposite from the mid-level multi-axis rods, the mid-level straight rod being part of two of the multipole rod sets.

14. The multi-device interface of claim 13, wherein the junction portion includes a bend having a radius of curvature.

15. The multi-device interface of claim 2, wherein the interface has a three dimensional configuration with the multipole rod sets being disposed along any of the three dimensions of the three dimensional configuration.

16. The multi-device interface of claim 15, wherein the multi-device interface includes six multipole rod sets and each of the multipole rod sets have a quadrupolar configuration with a square-shaped end profile.

17. The multi-device interface of claim 16, wherein adjacent rods in the multipole rod sets that are adjacent to one another are provided by a multi-axis rod generally having an L-shape, wherein the multi-axis rod includes two rod portions and a junction portion for connecting the two rod portions.

18. The multi-device interface of claim 17, wherein the junction portion includes a bend having a radius of curvature.

19. The multi-device interface of claim 1, wherein during use, the pressure within the multi-device interface is within the range of 1 mTorr to 3 Torr.

20. The multi-device interface of claim 1, wherein during use, the pressure within the multi-device interface is within the range of 1 mTorr to 1 Torr.

21. The multi-device interface of claim 1, wherein one of the multipole rod sets include a quadrupole rod set and a hexapole rod set adjacent and connected to one another.

22. The multi-device interface of claim 1, wherein at least two of the multipole rod sets are configured as input rod sets and the one or more ion sources include at least two of: an electrospray ionization ion source, an AP MALDI ion source, an AP chemical ionization ion source, an AP photoionization ion source, a MALDI ion source operating at pressures lower than atmospheric pressure, an electron impact ion source and a chemical ionization ion source.

23. A multi-device interface for use in mass spectrometry for interfacing two or more ion sources to a downstream device, wherein the multi-device interface comprises:

a) two or more input pathways having an inlet portion and an outlet portion, the inlet portion of each input pathway being connected to one of the multiple ion sources for receiving ions generated therefrom and transmitting the generated ions to the outlet portion;

b) a combination area in which the generated ions are combined to form combined ions, the combination area being located adjacent to the outlet portions of each of the input rod sets; and, c) an output pathway having an inlet portion and an outlet portion, the inlet portion being adjacent to the combination area for receiving the combined ions and transmitting the combined ions to the outlet portion of the output pathway and the outlet portion of the output pathway being connected to the downstream device.

24. A multi-device interface for use in mass spectrometry for interfacing one or more ion sources to one or more downstream devices, wherein the multi-device interface comprises three or more pathways and a transition area; wherein, the plurality of pathways are configured as either an input pathway, an output pathway or an unused pathway, each of the plurality of pathways that is configured as an input pathway is connected to and provides a separate pathway to the transition area, and each of the plurality of pathways that is configured as an output pathway is connected to the transition area and is connectable to one of the downstream devices, and wherein, during use, each of the plurality of pathways that is configured as an input pathway is connectable to a different ion source for receiving generated ions therefrom and leading the generated ions to the transition area where the generated ions are sent to one of the plurality of pathways that is configured as an output pathway and is connected to one of the downstream devices.

* * * * *